US006508172B2

(12) United States Patent
Kusaka

(10) Patent No.: US 6,508,172 B2
(45) Date of Patent: Jan. 21, 2003

(54) METHOD AND APPARATUS FOR IDENTIFYING AND DISTINGUISHING BETWEEN SHEETS ON A PRINTING PRESS WHERE THE SHEETS HAVE SOME DEFECTIVE AND NON-DEFECTIVE PRINT AREAS

(75) Inventor: Akehiro Kusaka, Chiba (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/892,033

(22) Filed: Jun. 25, 2001

(65) Prior Publication Data

US 2001/0054364 A1 Dec. 27, 2001

(30) Foreign Application Priority Data

Jun. 23, 2000 (JP) ..... 2000-189494

(51) Int. Cl.[7] ..... B41M 1/54
(52) U.S. Cl. ..... 101/483; 101/170
(58) Field of Search ..... 101/483, 17, 32, 101/129, 170, 211; 8/467; 204/2; 264/132; 346/1.1, 75; 347/101, 106

(56) References Cited

U.S. PATENT DOCUMENTS 4,448,121 A 5/1984 Uno et al.
5,471,309 A * 11/1995 Bolza-Schunemann ..... 250/548
5,548,691 A * 8/1996 Sato et al. ..... 358/1.12
6,192,140 B1 * 2/2001 Reinhard et al. .... 101/DIG. 42
6,260,456 B1 * 7/2001 Schaede ..... 83/34

* cited by examiner

*Primary Examiner*—Andrew H. Hirshfeld
*Assistant Examiner*—Charles H. Nolan, Jr.
(74) *Attorney, Agent, or Firm*—Blakely Sokoloff Taylor & Zafman

(57) ABSTRACT

In a sheet-like object identification method, a printing quality of each image of a sheet printed with a plurality of images is inspected. A sheet-like object in a printing state wherein all printed images are defective and a sheet-like object in a printing state wherein printed images mixedly include non-defective and defective printed images are identified on the basis of an inspection result. Different identification information are imparted to the sheet-like object in the printing state wherein all the images are defective and the printed sheet-like object in the printing state mixedly including non-defective and defective images on the basis of identification results. A sheet-like object identification apparatus is also disclosed.

23 Claims, 7 Drawing Sheets

METHOD AND APPARATUS FOR IDENTIFYING AND DISTINGUISHING BETWEEN SHEETS ON A PRINTING PRESS WHERE THE SHEETS HAVE SOME DEFECTIVE AND NON-DEFECTIVE PRINT AREAS

BACKGROUND OF THE INVENTION

The present invention relates to a sheet-like object identification method and apparatus for inspecting a sheet-like object printed with a plurality of images with a quality inspection unit and identifying whether the sheet-like object is non-defective.

Generally, in a sheet-like object identification method and apparatus of this type, a printed sheet-like object is inspected by a quality inspection unit arranged between a printing unit and a delivery unit, and a non-defective sheet-like object is delivered to a non-defective sheet pile. A defective sheet-like object is delivered to a defective sheet pile arranged in the delivery unit so that it is separated from the non-defective sheet-like object.

According to the conventional sheet-like object identification method described above, among images printed on one sheet-like object, when at one image is defective, even if the remaining images are non-defective, this sheet-like object is regarded as a printing error, and is delivered to the defective sheet pile and discarded. Accordingly, wasted sheet-like objects increase. When expensive sheet-like objects used for, e.g., securities, are wasted, the cost required for printing increases. In a printing press provided with an abnormality detection unit for detecting a supply abnormality such as a register defect of a sheet-like object, even a sheet-like object detected as being abnormal by the abnormality detection unit is regarded as a printing error and discarded although it is not printed at all. Accordingly, in this case as well, the cost required for printing increases.

SUMMARY OF THE INVENTION

It is an object of the present invention to provide a sheet-like object identification method and apparatus in which waste of a sheet-like object is eliminated and the cost required for printing is largely reduced.

In order to achieve the above object, according to the present invention, there is provided a sheet-like object identification method comprising the steps of inspecting a printing quality of each image of a sheet-like object printed with a plurality of images, identifying a sheet-like object in a printing state wherein all printed images are defective and a sheet-like object in a printing state wherein printed images mixedly include non-defective and defective images on the basis of inspection results, and imparting different identification information to the sheet-like object in the printing state wherein all the images are defective and the printed sheet-like object in the printing state mixedly including non-defective and defective images on the basis of identification results.

DESCRIPTION OF THE PREFERRED EMBODIMENTS

The present invention will be described in detail with reference to the accompanying drawings.

Figure 1:
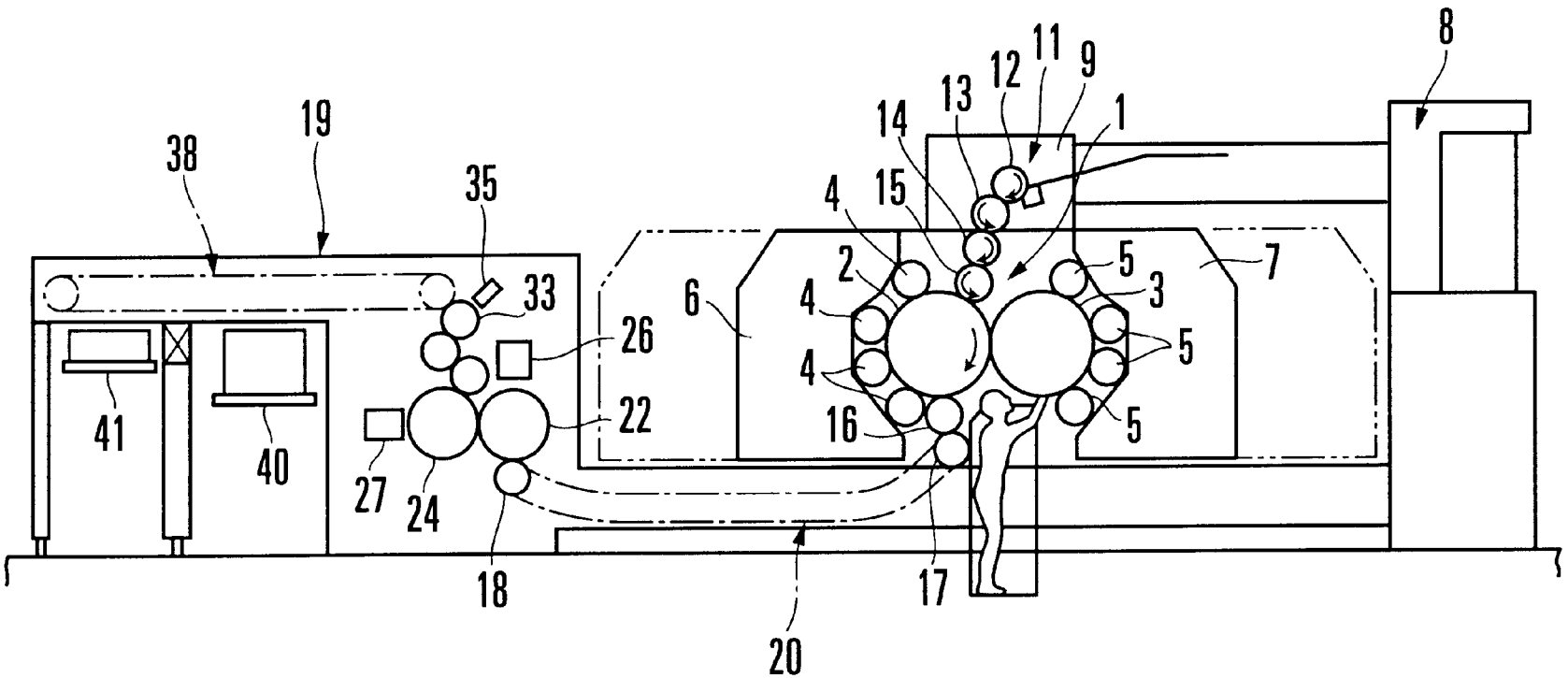
FIG. 1 is a side view schematically showing a satellite type printing press to which the present invention is applied.

FIG. 1 schematically shows a satellite type printing press according to the first embodiment of the present invention. In a satellite type printing press, a plurality of plate cylinders are arranged like satellites around a blanket cylinder, so they can perform multicolor printing simultaneously. Referring to FIG. 1, in a printing unit 1 for the satellite type printing press, a blanket impression cylinder 2 with a sheet gripper unit (not shown) and a blanket cylinder 3 without any sheet gripper unit are supported parallel to each other such that their outer surfaces are in contact opposite to each other. Four plate cylinders 4 are arranged in contact opposite to the outer surface of the blanket impression cylinder 2, and similarly four plate cylinders 5 are arranged in contact opposite to the outer surface of the blanket cylinders 3. Inking units 6 and 7 can move close to and away from the plurality of plate cylinders 4 and 5, respectively, and can supply ink and water to the plate cylinders 4 and 5 while in contact with them.

Figure 4:
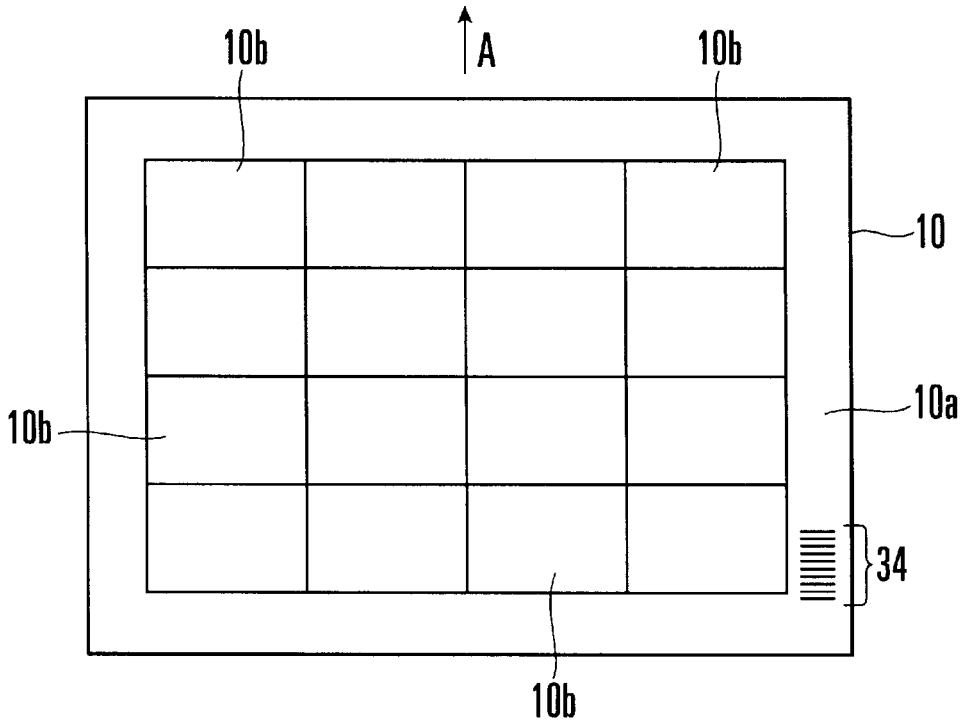
FIG. 4 is a plan view of a sheet to be used by the present invention, on which a plurality of images are printed.

The above printing press performs double-sided printing of 16 images on each of the upper and lower surfaces of a sheet, leading to a total of 32 images 10*b*, as shown in FIG. 4. A margin 10*a* as a non-printing region is set around the 16 printed images on each of the upper and lower surfaces of a sheet 10.

Referring to FIG. 1, a sheet 10 fed from a sheet feeder 8 through a feeder board 9 is aligned in the circumferential and lateral directions at a register 11, and is transferred to the sheet gripper unit (not shown) of the blanket impression cylinder 2 through transfer cylinders 12, 13, 14, and 15 each with a sheet gripper unit (not shown). The sheet 10 with double-sided printed by the blanket impression cylinder 2 and blanket cylinder 3 is gripped by the sheet gripper unit (not shown) of a transfer cylinder 16, then transferred to the delivery gripper member (not shown) of a first delivery chain 20 extending between a delivery cylinder 17 of the printing unit 1 and a delivery cylinder 18 of a delivery unit 19, and is conveyed to the delivery unit 19.

Figure 2:
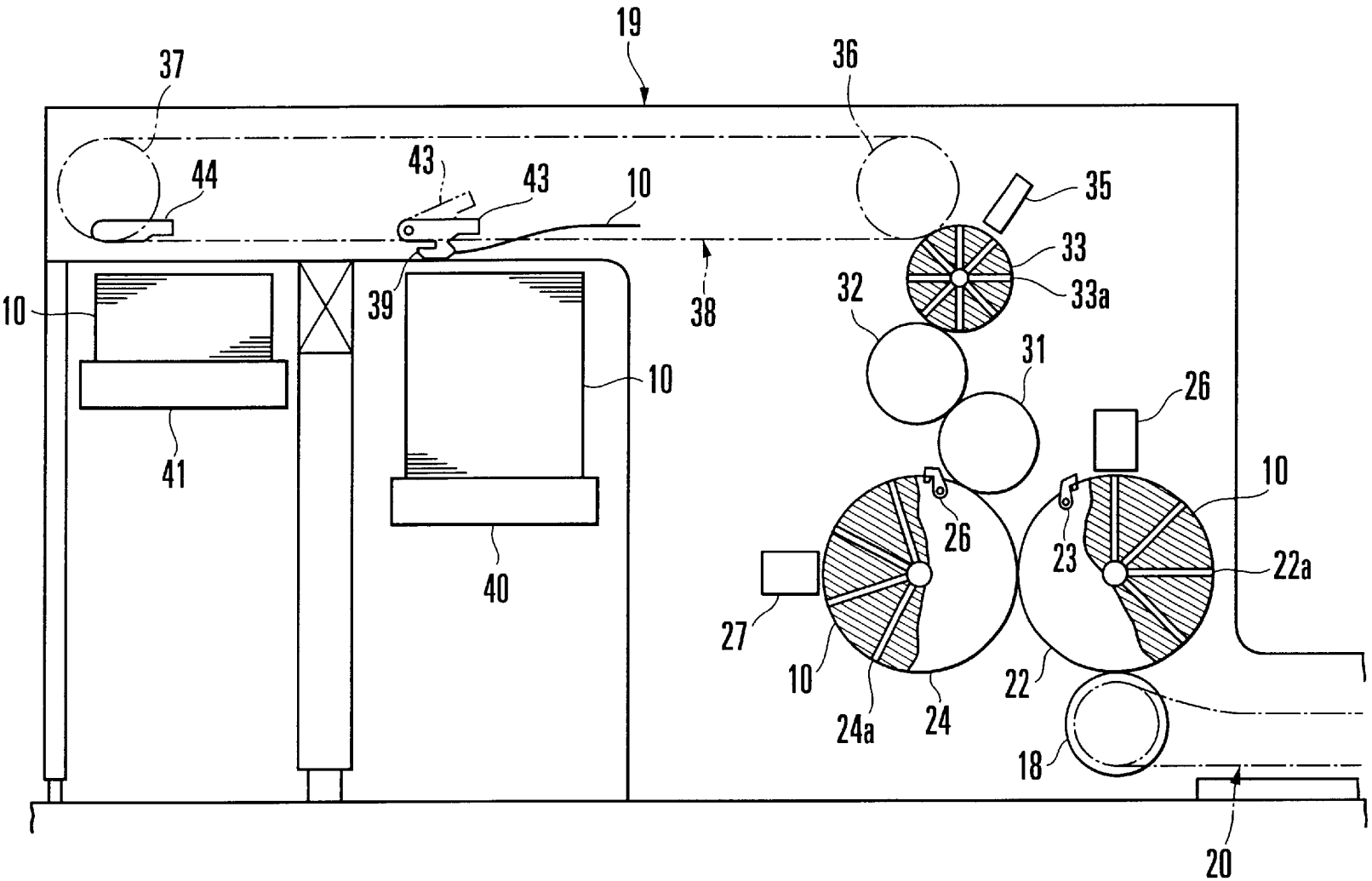
FIG. 2 is an enlarged side view of the main part of the delivery unit shown in FIG. 1.

As shown in FIG. 2, the delivery unit 19 has a large-diameter first inspection cylinder 22 in contact opposite to the delivery cylinder 18, and a large-diameter second inspection cylinder 24 in contact opposite to the first inspection cylinder 22. The inspection cylinders 22 and 24 have gripper units 23 and 25, respectively. An upper-surface inspection unit 26 for inspecting the quality of images printed on the upper surface of the sheet 10 is arranged close to the outer surface of the first inspection cylinder 22. A lower-surface inspection unit 27 for inspecting the quality of images printed on the lower surface of the sheet 10 is arranged close to the outer surface of the second inspection cylinder 24.

Each of the upper- and lower-surface inspection units 26 and 27 has a digital camera with a group of CCD (Charge Coupled Device) sensors lined up in one or a plurality of rows in the widthwise direction of the sheet 10 (direction perpendicular to the sheet convey direction). Each of the upper- and lower-surface inspection units 26 and 27 detects the printing density for each image printed on the sheet 10, and checks whether the image is non-defective or defective in accordance with the result of comparison between a detection value and the density value of a standard image. For example, when the detection value of a image and the density value of the standard image differ due to contamination with oil or offset, it is determined that this image is defective.

Three transfer cylinders 31, 32, 33 respectively have gripper units (not shown), and their outer surfaces are in contact opposite to each other. The transfer cylinder 31 is in contact opposite to the second inspection cylinder 24. The three transfer cylinders 31, 32, and 33 are arranged in the staggered manner in the vertical direction. An ink-jet printer 35 serving as an identification information imparting means is arranged close to the outer surface of the transfer cylinder 33, and prints a bar code 34, serving as the first to fourth identification marks indicating the printing state and the presence/absence of a registration error, on the margin 10*a* (FIG. 4) of the sheet 10 gripped by the gripper unit of the transfer cylinder 33 and conveyed. The first and second inspection cylinders 22 and 24 and the transfer cylinder 33 respectively have a large number of suction holes 22*a*, 24*a*, and 33*a*, connected to an air source (not shown), on their outer surfaces. During inspection and printing, the sheet 10 is drawn to the outer surfaces of the cylinders 22, 24, and 33 by suction air from the air source to the suction holes.

In the upper portion of the delivery unit 19, a second delivery chain 38 extends between delivery cylinders 36 and 37 arranged in the sheet convey direction. Delivery gripper members 39 for gripping and conveying the sheet 10 are supported on the second delivery chain 38 at a predetermined interval. A non-defective sheet pile 40 is provided under the substantial central portion of the second delivery chain 38. A defective sheet pile 41 is provided under the terminal end of the second delivery chain 38. A delivery cam 43 serving as a delivery switching means is provided above the non-defective sheet pile 40. The delivery cam 43 is supported such that it can be moved between the operative position indicated by a solid line in FIG. 2 and the retreat position indicated by an alternate long and two short dashed line in FIG. 2 by a driving means (not shown).

When the delivery cam 43 is located at the perative position, the cam follower (not shown) of the delivery gripper members 39 that has traveled with the second delivery chain 38 engages with the delivery cam 43. Thus, the delivery gripper members 39 release the sheet 10, and the sheet 10 drops onto the non-defective sheet pile 40. When the delivery cam 43 is located at the retreat position, the cam follower (not shown) of the delivery gripper members 39 that has traveled does not engage with the delivery cam 43. Thus, the sheet 10 is conveyed while being gripped by the delivery gripper members 39. The cam follower of the delivery gripper members 39 which has traveled without engaging with the delivery cam 43 while gripping the sheet 10 engages with a stationary delivery cam 44 arranged above the defective sheet pile 41. Therefore, the delivery gripper members 39 release the sheet 10, and the sheet 10 drops onto the defective sheet pile 41.

Figure 3:
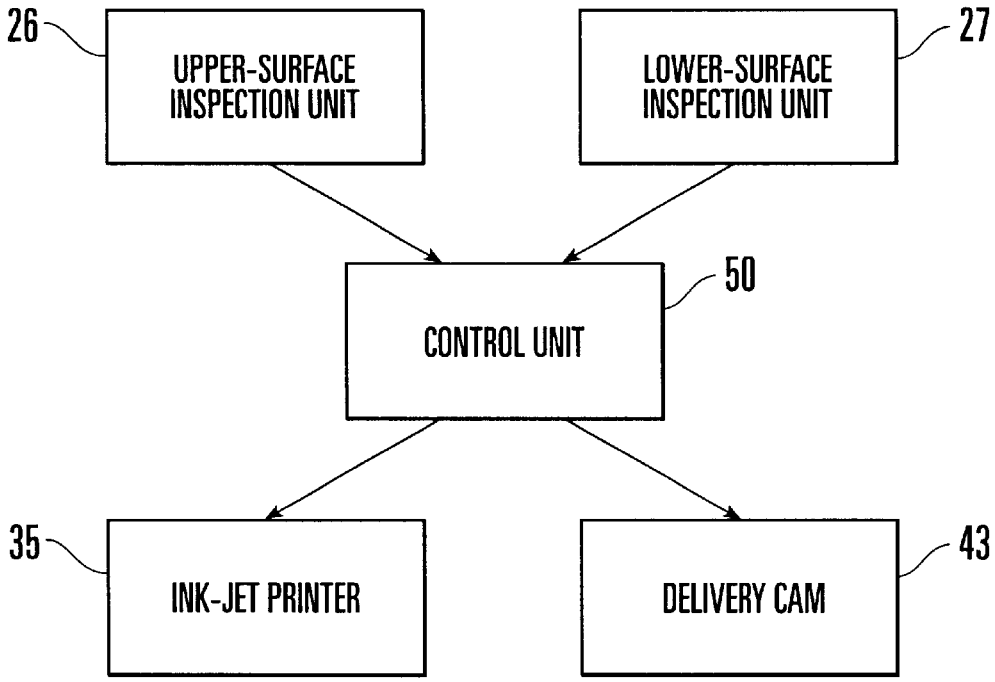
FIG. 3 is a block diagram of a sheet-like object identification apparatus according to the first embodiment of the present invention.

FIG. 3 shows functional blocks of a sheet-like object identification apparatus including the upper-surface inspection unit 26, lower-surface inspection unit 27, ink-jet printer 35, and delivery cam 43 described above. Referring to FIG. 3, the sheet-like object identification apparatus further has a control unit 50 comprising a CPU (Central Processing Unit) connected to the above elements to perform a process in accordance with the stored program.

On the basis of the inspection results of the upper- and lower-surface inspection units 26 and 27, the control unit 50 controls the ink-jet printer 35 to print the bar code 34, serving as the first to fourth identification marks, on the margin 10*a* of the sheet 10, and controls the delivery cam 43 to move to the operative and retreat positions. More specifically, the control unit 50 checks the printing state of each image of the sheet 10 on the basis of the non-defective/defective signals output from the upper- and lower-surface inspection units 26 and 27, and controls the ink-jet printer 35 and delivery cam 43 on the basis of the checking result.

The operation of the sheet-like object identification apparatus with the above arrangement will be described with reference to the flow charts of FIGS. 5A and 5B.

The sheet 10 fed from the sheet feeder 8 to the feeder board 9 is sequentially conveyed by the four transfer cylinders 12 to 15 (step S1), and gripped by the gripper unit of the blanket impression cylinder 2. The sheet 10 gripped by the blanket impression cylinder 2 is subjected to double-sided printing while it passes between the blanket impression cylinder 2 and blanket cylinder 3 (step S2), is then gripped by the delivery gripper members of the first delivery chain 20 through the transfer cylinder 16, and is conveyed to the delivery cylinder 18 of the delivery unit 19.

As shown in FIG. 2, after the sheet 10 is transferred from the delivery gripper members of the first delivery chain 20 to the gripper unit 23 of the first inspection cylinder 22, its upper-surface printing state is inspected by the upper-surface inspection unit 26 (step S3). The upper-surface inspection unit 26 outputs inspection information to the control unit 50. While being inspected by the upper-surface inspection unit 26, the sheet 10 is drawn to the outer surface of the first inspection cylinder 22 by the suction unit. Thus, inspection of the upper surface of the sheet 10 is correctly performed without fluttering the sheet 10.

After the sheet 10 is transferred from the gripper unit 23 of the first inspection cylinder 22 to the gripper unit 25 of the second inspection cylinder 24, its lower-surface printing state is inspected by the lower-surface inspection unit 27 (step S4). The lower-surface inspection unit 27 outputs inspection information to the control unit 50. While being inspected by the lower-surface inspection unit 27, the sheet 10 is drawn to the outer surface of the second inspection cylinder 24 by the suction unit. Thus, inspection of the lower surface of the sheet 10 is correctly performed without fluttering the sheet 10. The sheet 10 transferred from the gripper unit 25 of the second inspection cylinder 24 to the gripper unit of the transfer cylinder 31 is conveyed as it is sequentially transferred from the transfer cylinder 32 to the gripper unit of the transfer cylinder 33.

The control unit 50 checks whether all the 32 images 10*b* printed on the upper and lower surfaces of the sheet 10 are non-defective on the basis of the inspection results of the upper- and lower-surface inspection units 26 and 27. If all the images 10*b* are non-defective, the control unit 50 controls the ink-jet printer 35 to print the bar code 34, serving as the first identification mark, on the margin 10*a* of the sheet 10 (step S6). The process time of the control unit 50 required for printing the bar code 34, serving as the first identification mark indicating that all printed images on this sheet are so non-defective, with the ink-jet printer 35 is assured by the time during which the sheet 10 is conveyed by the transfer cylinders 31 and 32.

Since the sheet 10 is drawn to the outer surface of the transfer cylinder 33 by the suction unit, the bar code 34 is printed by the ink-jet printer 35 reliably and correctly. Then, the control unit 50 controls the delivery cam 43 to move to the operative position (step S7). Thus, the sheet 10 transferred from the gripper unit of the transfer cylinder 33 to the delivery gripper members 39 of the second delivery chain 38 is released from the delivery gripper members 39 because of the delivery cam 43. The released sheet 10 drops onto the non-defective sheet pile 40 and stacked there (step S8).

In step S5, if all the 32 images lob printed on the sheet 10 are not non-defective, the control unit 50 checks whether all the images 10*b* printed on the sheet 10 are defective (step S10). If YES, the control unit 50 checks whether the upper and lower surfaces of the sheet 10 are not printed at all, that is, whether the sheet 10 is a blank sheet (step S11). If YES, the control unit 50 controls the ink-jet printer 35 to print the bar code 34, serving as the fourth identification mark indicating that the sheet 10 is a blank sheet, on the margin 10*a* of the sheet 10. Then, the control unit 50 controls the delivery cam 43 to move to the retreat position (step S13). Thus, the sheet 10 transferred from the gripper unit of the transfer cylinder 33 to the delivery gripper members 39 of the second delivery chain 38 passes through the delivery cam 43, and is released from the delivery gripper members 39 by the stationary delivery cam 44. The released sheet 10 drops onto the defective sheet pile 41 and stacked there (step S14).

In step S11, if the sheet is not a blank sheet, that is, if all the 32 images lob printed on the sheet 10 are defective, the control unit 50 controls the ink-jet printer 35 to print the bar code 34, serving as the second identification mark indicating that all the images are defective, on the margin 10*a* of the sheet 10 (step S15). Then, the control unit 50 controls the delivery cam 43 to move to the retreat position (step S16). Thus, the sheet 10 transferred from the gripper unit of the transfer cylinder 33 to the delivery gripper members 39 of the second delivery chain 38 passes through the delivery cam 43, and is released from the delivery gripper members 39 by the stationary delivery cam 44. The released sheet 10 drops onto the defective sheet pile 41 and stacked there (step S17).

In step S10, if all the 32 images 10*b* printed on the sheet are not defective, that is, of the 32 images 10*b* printed on the sheet 10, if at least one image is defective and at least one image is non-defective, the control unit 50 controls the ink-jet printer 35 to print the bar code 34, serving as the third identification mark indicating that non-defective and defective images are mixed, on the margin 10*a* of the sheet 10 (step S18). Then, the control unit 50 controls the delivery cam 43 to move to the retreat position (step S19). Thus, the sheet 10 transferred from the gripper unit of the transfer cylinder 33 to the delivery gripper members 39 of the second delivery chain 38 passes through the delivery cam 43, and is released from the delivery gripper members 39 by the stationary delivery cam 44. The released sheet 10 drops onto the defective sheet pile 41 and stacked there (step S20).

Therefore, only those sheets 10 in each of which all the 32 images 10*b* are non-defective are stacked on the non-defective sheet pile 40. Those sheets 10 in each of which at least one of the 32 images 10*b* is determined as defective are stacked on the defective sheet pile 41, so they are separated from those sheets 10 in each of which all the 32 images 10*b* are non-defective. When the sheets 10 printed with the third identification marks are extracted from the sheets 10 stacked on the defective sheet pile 41, those sheets 10 in each of which at least one image is defective and at least one image is non-defective can be separated from the defective sheets 10.

Since at least one non-defective image can be used, the cost required for printing can be reduced. Since the blank sheet 10 printed with the fourth identification mark is extracted and set in the sheet feeder 8 again, the sheet 10 can be used again. Thus, the blank sheet 10 is not wasted, and the cost required for printing can be reduced. When the bar code 34 is printed as the identification mark, the printing speed can be set higher than in a case wherein a numeral, symbol, or the like is printed, and the identification process can be performed quickly.

Since the inspection cylinders 22 and 24 and the transfer cylinders 31, 32, and 33 are set between the first and second delivery chains 20 and 38 to replace part of the delivery chain, double-sided quality inspection can be performed in-line from double-sided printing to delivery without increasing the installation space or the entire machine length. Since the sheet 10 is drawn to the outer surfaces of the inspection cylinders 22 and 24 and transfer cylinder 33 by suction air from the suction holes 22*a*, 24*a*, and 33*a*, inspection of the printing state of the sheet 10 and bar code printing on the sheet 10 can be performed reliably without fluttering the sheet 10. Since a suction guide or the like is unnecessary, the inspection units 26 and 27 can be mounted easily, which is effective in terms of installation space. Since the transfer cylinders 31, 32, and 33 are arranged in the staggered manner in the vertical direction, the inspection units 26 and 27 can be mounted easily, which is effective in terms of installation space.

Figure 6:
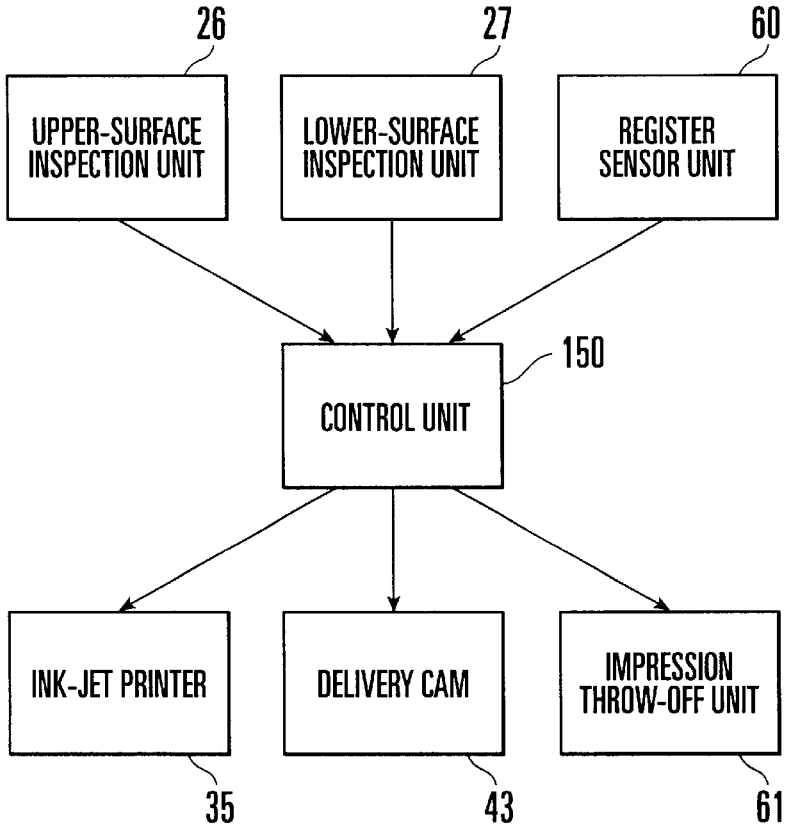
FIG. 6 is a block diagram of a sheet-like object identification apparatus according to the second embodiment of the present invention.
Figure 7:
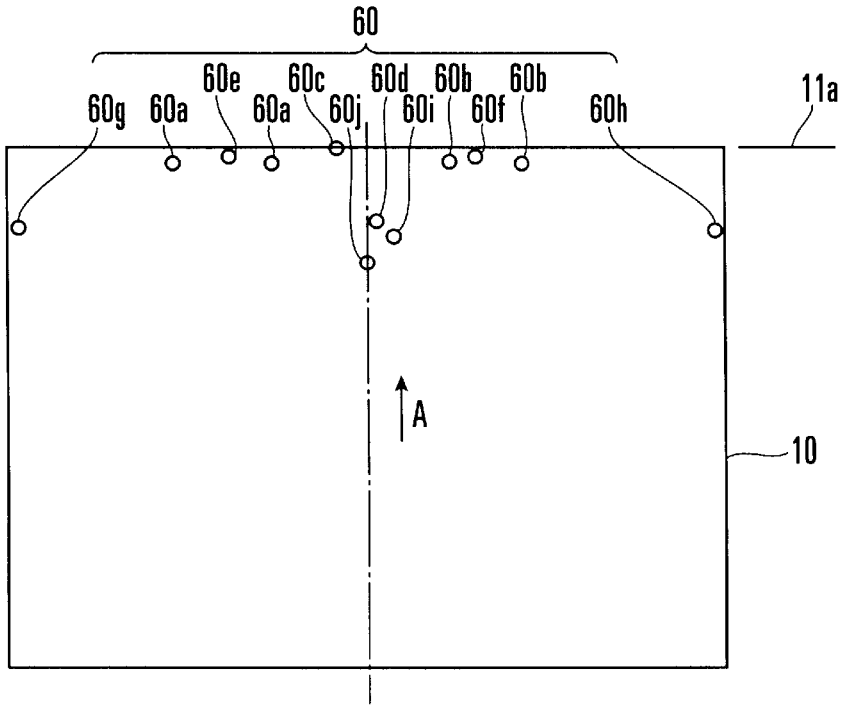
FIG. 7 is a plan view of a register showing the arrangement of various types of detection sensors that make up the register sensor unit shown in FIG. 6.

FIG. 6 shows functional blocks of a sheet-like object identification apparatus according to the second embodiment of the present invention. The sheet-like object identification apparatus shown in FIG. 6 has, in addition to the arrangement shown in FIG. 3, a register sensor unit 60 and impression throw-off unit 61 connected to a control unit 150. As shown in FIG. 7, the register sensor unit 60 is made up of various types of detection sensors 60*a* to 60*j* for detecting a registration error by detecting the state of a sheet 10 the leading edge of which abuts against a front lay 11*a* of a register 11.

Referring to FIG. 7, the two left large-skew detection sensors 60*a* detect a state wherein the sheet 10 is on the large skew to the left from a sheet convey direction A. The two right large-skew detection sensors 60*b* detect a state wherein the sheet 10 is on the large skew to the right from the sheet convey direction A. The front-over sensor 60*c* detects a state wherein the sheet 10 has overrun the front lay 11*a* in the sheet convey direction A. The double-sheet sensor 60*d* detects a state wherein sheets are fed in an overlaying state.

The left front-skew detection sensor 60*e* detects a state wherein the left leading edge of the sheet 10 in the sheet convey direction A does not abut against the front lay 11*a*. The right front-skew detection sensor 60*f* detects a state wherein the right leading edge of the sheet 10 in the sheet convey direction A does not abut against the front lay 11*a*. The left side-skew detection sensor 60*g* detects a state wherein the left edge of the sheet 10 in the sheet convey direction A is not parallel to the convey direction A of the sheet 10. The right side-skew detection sensor 60*h* detects a state wherein the right edge of the sheet 10 in the sheet convey direction A is not parallel to the convey direction A of the sheet 10. The cylinder impression throw-on detection sensor 60*i* detects whether a blanket impression cylinder 2 and blanket cylinder 3 are set in the throw-on state. The test sheet sensor 60*j* detects a test sheet.

Referring to FIG. 6, the control unit 150 controls the operation of the impression throw-off unit 61 in accordance with a registration error signal from the register sensor unit 60. More specifically, when a registration error of the sheet 10 at the register 11 is detected by the register sensor unit 60, the control unit 150 controls the impression throw-off unit 61 to set the blanket impression cylinder 2 and blanket cylinder 3 in the throw-off state.

Figure 8:
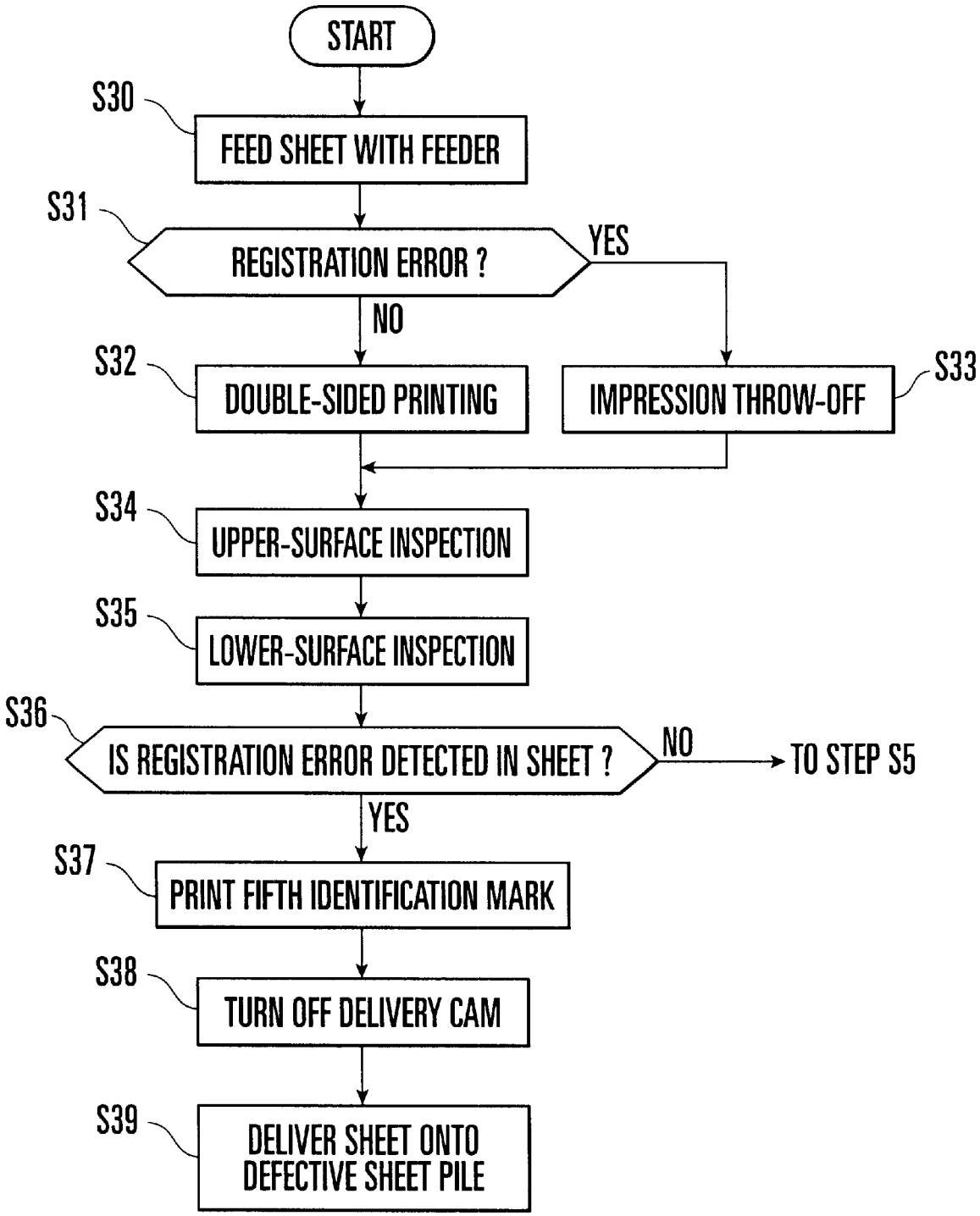
FIG. 8 is a flow chart for explaining identification operation performed by the sheet-like object identification unit shown in FIG. 6.

The operation of the sheet-like object identification apparatus with the above arrangement will be described with reference to the flow chart of FIG. 8.

When the sheet 10 is fed from a sheet feeder 8 to a feeder board 9 (step S30), it is conveyed to the register 11. The leading edge of the sheet 10 conveyed to the register 11 abuts against the front lay 11*a* of the register 11, so the sheet 10 is aligned in the circumferential and lateral directions. At this time, when the register sensor unit 60 detects a registration error of the sheet 10, it outputs a registration error signal to the control unit 150 (step S31). When the registration error signal is output from the register sensor unit 60, the control unit 150 controls the impression throw-off unit 61 to set the blanket impression cylinder 2 and blanket cylinder 3 in the throw-off state (step S33).

The sheet 10 with the detected registration error is sequentially conveyed by transfer cylinders 12 to 15, is gripped by the gripper unit of the blanket impression cylinder 2, and passes between the blanket impression cylinder 2 and blanket cylinder 3 that are in the throw-off state. After passing between the blanket impression cylinder 2 and blanket cylinder 3, the sheet 10 is transferred to the delivery gripper members of a first delivery chain 20 through a transfer cylinder 16, and is conveyed toward a delivery cylinder 18 of a delivery unit 19 as the first delivery chain 20 travels.

At the delivery unit 19, after the sheet 10 is transferred from the delivery gripper members of the first delivery chain 20 to a gripper unit 23 of a first inspection cylinder 22, its upper-surface printing state is inspected by an upper-surface inspection unit 26 (step S34). The upper-surface inspection unit 26 outputs inspection information to the control unit 150. After the sheet 10 is transferred from the gripper unit 23 of the first inspection cylinder 22 to a gripper unit 25 of a second inspection cylinder 24, its lower-surface printing state is inspected by a lower-surface inspection unit 27 (step S35). The lower-surface inspection unit 27 outputs inspection information to the control unit 150.

On the basis of the inspection information from the register sensor unit 60, upper-surface inspection unit 26, and lower-surface inspection unit 27, when the control unit 150 determines that a registration error is detected in the sheet 10, it controls an ink-jet printer 35 to print a bar code 34, serving as the fifth identification mark, on a margin 10*a* of the sheet 10 (step S37). Then, the control unit 150 controls a delivery cam 43 to move to a retreat position (step S38). Thus, the sheet 10 transferred from the gripper unit of a transfer cylinder 33 to delivery gripper members 39 of a second delivery chain 38 passes through the delivery cam 43, and is released from the delivery gripper members 39 by a stationary delivery cam 44. The released sheet 10 drops onto a defective sheet pile 41 and stacked there (step S39).

Therefore, the sheet 10 in which the registration error is detected can be extracted from the sheets stacked on the defective sheet pile 41 on the basis of the fifth identification mark. The sheet 10 which is not subjected to printing due to its registration error is supplied to the sheet feeder 8 so that it can be used for printing again. Hence, the sheet 10 with the registration error is not wasted, and the cost required for printing can be reduced.

Figure 5A:
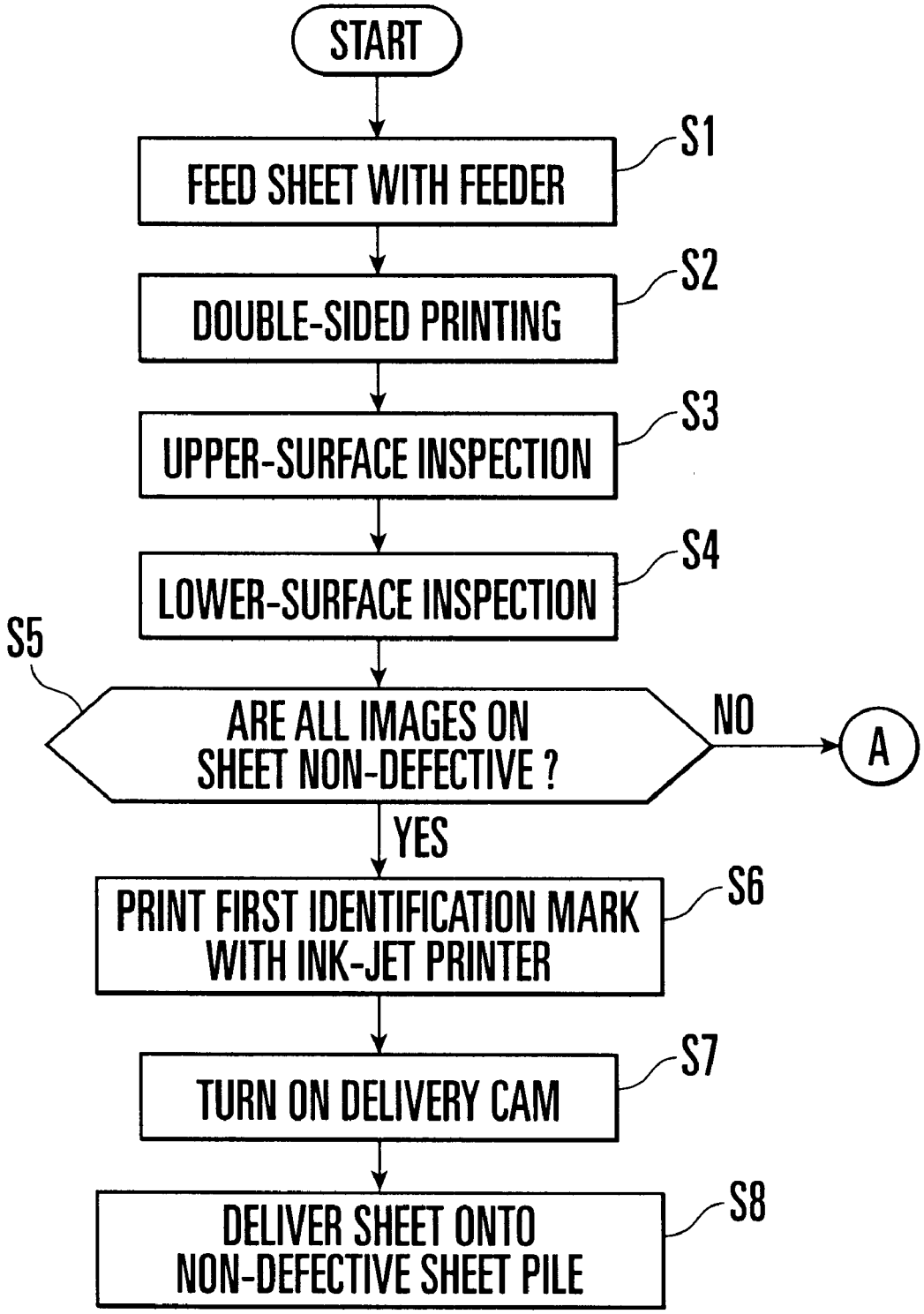
FIGS. 5A and 5B are flow charts for explaining identification operation performed by the sheet-like object identification unit shown in FIG. 3.
Figure 5B:
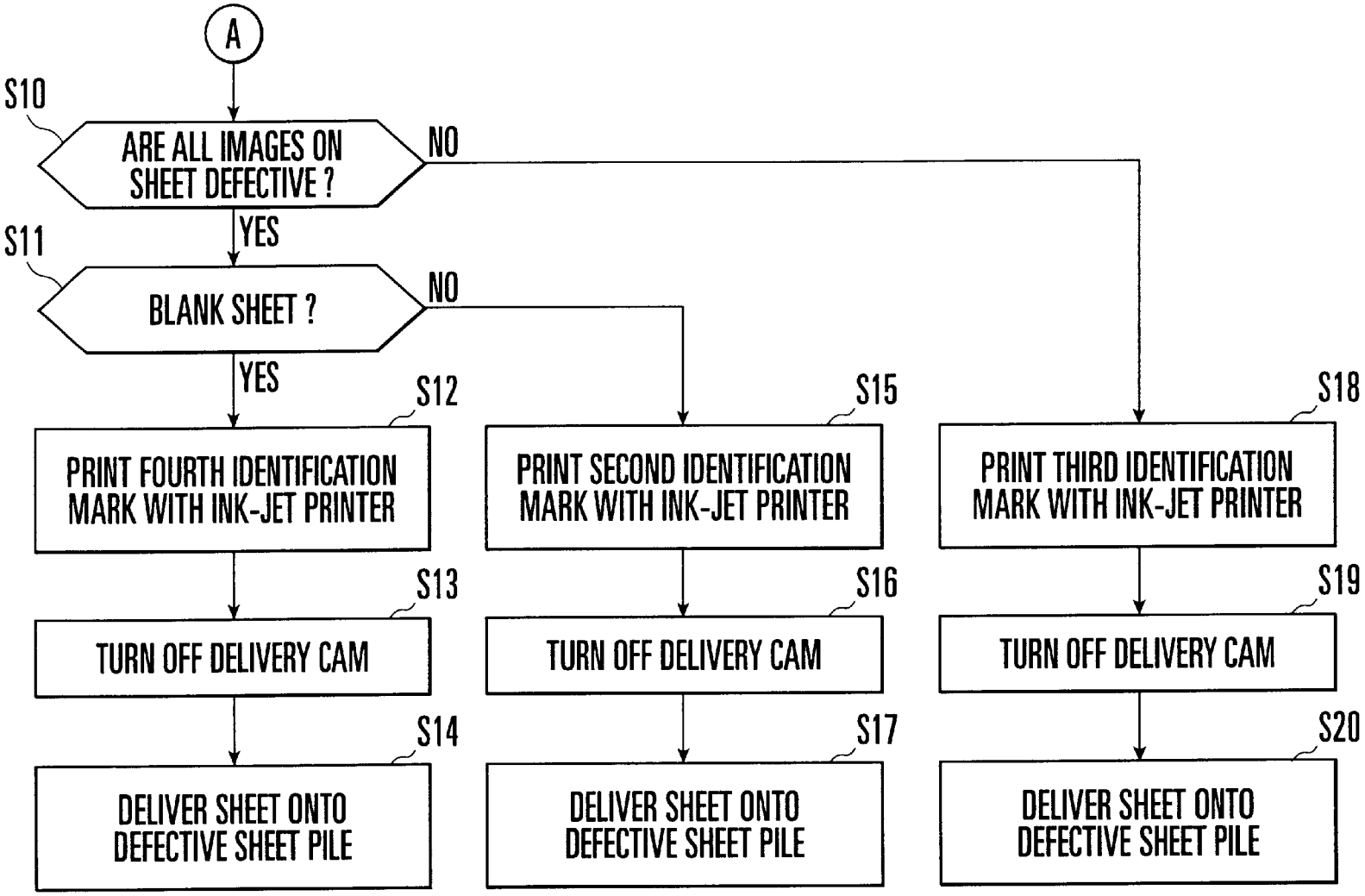

A sheet 10 not having a registration error is sequentially subjected to double-sided printing, upper-surface inspection, and lower-surface inspection (steps S32, S34, and S35), in the same manner as in steps S2 to S4 shown in FIG. 5A, and it is similarly checked whether the sheet 10 has a detected registration error (step S36). In this case, since no registration error is detected in the sheet 10, the flow advances to step S5 shown in FIG. 5A. Then, the bar code 34 serving as the first to fourth identification marks is printed on the sheet 10 on the basis of the results of the upper- and lower-surface inspection, as described in the first embodiment.

In the above embodiments, the identification mark is the bar code 34. Alternatively, different colors may be printed on the respective sheet-like objects to correspond to the first to fifth identification marks. A code number (numeral or symbol) may be directly printed on the sheet-like object, or a large number of identifiable holes may be formed in the sheet-like object by a laser or punching mechanism. A blank sheet 10 may not be printed with the fifth identification mark so it can be used again. The first identification mark indicating that the sheet with this mark is non-defective need not always be printed.

The bar code 34 may not serve as the first to fifth identification marks, but the sheets 10 may be printed with serial numbers for each sorting group, or all the sheets 10 may be printed with serial numbers. In this case, the serial numbers and the printing states of the sheets 10 for each sorting group are set to correspond to each other, and the sheets 10 are managed by a storage.

In the above embodiments, one non-defective sheet pile 40 is provided. Alternatively, two or more non-defective sheet piles 40 may be provided, and a delivery cam 43 may be provided above each non-defective sheet pile 40. In this case, when one pile becomes full, the corresponding delivery cam 43 is switched so that the subsequent sheets are delivered to other empty piles. Then, the printing press is not stopped and the sheets 10 can be continuously delivered.

In the above embodiments, the sheets 10 are sorted between the non-defective sheet pile 40 and defective sheet pile 41. Alternatively, the sheets 10 may be sorted among five piles to correspond to the first to fifth identification marks. The sheets 10 may not be sorted by the delivery unit 19, but be automatically sorted by stacking them altogether on one pile and thereafter identifying their identification marks at a different location. In this case, the sheets 10 can be sorted more reliably and quickly than with the method with which the operator sorts the sheets 10 by referring to the bar codes.

In the above embodiments, the upper- and lower-surface inspection units 26 and 27 check the non-defectiveness/defectiveness for each image. Alternatively, the control unit 50 may check the non-defectiveness/defectiveness on the basis of image information output from the upper- and lower-surface inspection units 26 and 27. The sheet-like object is described as a paper sheet 10. Alternatively, the sheet-like object may be a film-like sheet made of vinyl chloride or the like.

As has been described above, according to the present invention, the sheet-like objects in the various types of states can be identified by referring to identification marks on the basis of inspection results of the registration error and printing state. Therefore, a sheet having both non-defective and defective images can be extracted, so only non-defective images can be used. A sheet-like object which is not printed because of a registration error, and a blank sheet-like object can be extracted on the basis of the identification marks, and can be used again for printing. As a result, the sheet-like objects may not be wasted, and the cost required for printing can be reduced.

What is claimed is:

1. A sheet object identification method comprising the steps of:

inspecting a printing quality of each image of a sheet object printed with a plurality of images;

identifying a sheet object in a printing state wherein all printed images are defective and a sheet object in a printing state wherein printed images mixedly include non-defective and defective images on the basis of inspection results; and imparting different identification information to the sheet object in the printing state wherein all the images are defective and the printed sheet object in the printing state mixedly including non-defective and defective images on the basis of identification results.

2. A method according to claim 1, wherein the step of identifying comprises the step of identifying a sheet object in a first printing state wherein all printed images are non-defective, a sheet object in a second printing state wherein all printed images are defective, and a sheet object in a third printing state wherein printed images mixedly include non-defective and defective images, and the step of imparting comprises the step of imparting first to third identification information to the sheet objects in the first to third printing states.

3. A method according to claim 2, wherein the step of identifying further comprises the step of identifying a blank sheet object in a fourth printing state with no images being printed, and the step of imparting further comprises the step of imparting fourth identification information to the sheet object in the fourth printing state.

4. A method according to claim 3, wherein the method further comprises the steps of detecting a registration error of a sheet object before printing, and delivering a sheet object with a detected registration error without performing printing, and the step of imparting further comprises the step of imparting fifth identification information to the sheet object with the detected registration error.

5. A method according to claim 4, wherein the step of delivering comprises the step of driving an impression throw-off means in order to set blanket cylinders constituting a printing unit in a throw-off state, thereby delivering the sheet object with the detected registration error without performing printing.

6. A method according to claim 4, further comprising the step of sorting the sheet objects in the second to fourth printing states and the sheet object with the detected registration error to a defective sheet pile.

7. A method according to claim 1, further comprising the steps of identifying a sheet object in a printing state wherein all printed images are non-defective, sorting the sheet object in the printing state wherein all the printed images are non-defective to a non-defective sheet pile, and sorting a sheet object in a printing state wherein printed images at least include a defective image to a defective sheet pile.

8. A method according to claim 1, wherein the step of inspecting comprises the step of inspecting images printed on double-sided of the sheet object.

9. A method according to claim 1, wherein the step of imparting comprises the step of recording an identification mark on the sheet object as identification information.

10. A method according to claim 9, wherein the step of recording comprises the step of printing a bar code on a margin of the sheet object.

11. A sheet object identification apparatus comprising:

inspection means for inspecting a printing quality of each image of a sheet object printed with a plurality of images;

identification means for identifying a sheet object in a printing state wherein all printed images are defective and a sheet object in a printing state wherein printed images mixedly include non-defective and defective images on the basis of inspection results of said inspection means; and imparting means for imparting different identification information to the sheet object in the printing state wherein all the images are defective and the printed sheet object in the printing state mixedly including non-defective and defective images on the basis of identification results of said identification means.

12. An apparatus according to claim 11, wherein said identification means identifies a sheet object in a first printing state wherein all printed images are non-defective, a sheet object in a second printing state wherein all printed images are defective, and a sheet object in a third printing state wherein printed images mixedly include non-defective and defective printed images, and said imparting means imparts first to third identification information to the sheet objects in the first to third printing states.

13. An apparatus according to claim 12, wherein said identification means further identifies a blank sheet object in a fourth printing state with no images being printed, and said imparting means imparts fourth identification information to the sheet object in the fourth printing state.

14. An apparatus according to claim 13, wherein said apparatus further comprises registration error detection means for detecting a registration error of a sheet object before printing, and said imparting means imparts fifth identification information to the sheet object with the detected registration error by said registration error detection means.

15. An apparatus according to claim 14, further comprising an impression throw-off means for setting blanket cylinders constituting a printing unit in a throw-off state, when said registration error detection means detects a registration error, t hereby delivering the sheet object with the detected registration error without performing printing.

16. An apparatus according to claim 14, further comprising sorting means for sorting the sheet objects in the second to fourth printing states and the sheet object with the detected registration error to a defective sheet pile.

17. An apparatus according to claim 11, wherein said apparatus further comprises sorting means for sorting the sheet object in the printing state wherein all the printed images are non-defective to a non-defective sheet pile and the sheet object in a printing state wherein printed images at least include a defective image to a defective sheet pile, and said identification means further identifies the sheet object in the printing state wherein all the printed images are non-defective and outputs an identification to said sorting means.

18. An apparatus according to claim 11, wherein said inspection means comprises an upper-surface inspection unit for inspecting an upper surface of the sheet object and a lower-surface inspection unit for inspecting a lower surface of the sheet object.

19. An apparatus according to claim 18, wherein said apparatus further comprises a convey cylinder group comprised of a plurality of convey cylinders for conveying the printed sheet object to a delivery unit, said imparting means comprises a printer unit for printing identification information on the printed sheet object, and said upper-surface inspection unit, said lower-surface inspection unit, and said printer unit are arranged to respectively oppose three convey cylinders that make up said convey cylinders.

20. An apparatus according to claim 19, wherein said three convey cylinders have a plurality of suction holes on outer surfaces thereof, and said upper-surface inspection unit, said lower-surface inspection unit, and said printer unit perform inspection and printing for a sheet object drawn to the outer surfaces of said three convey cylinders by suction air from the suction holes.

21. An apparatus according to claim 19, further comprising first convey means for conveying the sheet object to said convey cylinder group after printing, and second convey means for conveying the sheet object from said convey cylinder group to said delivery unit.

22. An apparatus according to claim 11, wherein said imparting means comprises a printing press for printing an identification mark on the sheet object as identification information.

23. An apparatus according to claim 22, wherein said printing press comprises a bar code printing press for printing a bar code on a margin of the sheet object.

* * * * *